US010556714B2

(12) United States Patent
Magerstedt

(10) Patent No.: US 10,556,714 B2
(45) Date of Patent: Feb. 11, 2020

(54) CONTAINER TREATMENT DEVICE WITH A DEVICE FOR REPLACING RETAINING AND CENTERING UNITS

(71) Applicant: KHS GmbH, Dortmund (DE)

(72) Inventor: Stefan Magerstedt, Dortmund (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/756,304

(22) PCT Filed: Aug. 4, 2016

(86) PCT No.: PCT/EP2016/068705
§ 371 (c)(1),
(2) Date: Feb. 28, 2018

(87) PCT Pub. No.: WO2017/036731
PCT Pub. Date: Mar. 9, 2017

(65) Prior Publication Data

US 2018/0244417 A1 Aug. 30, 2018

(30) Foreign Application Priority Data

Aug. 28, 2015 (DE) ..... 10 2015 114 344

(51) Int. Cl.

| | |
|---|---|
| ***B65B 59/04*** | (2006.01) |
| ***B41J 3/407*** | (2006.01) |
| ***B65B 61/02*** | (2006.01) |
| ***B65B 65/00*** | (2006.01) |

(52) U.S. Cl.
CPC ..... *B65B 59/04* (2013.01); *B41J 3/4073* (2013.01); *B65B 61/025* (2013.01); *B65B 65/003* (2013.01)

(58) Field of Classification Search
CPC ..... B65G 59/04
USPC ..... 198/867.01–867.15, 473.1
See application file for complete search history.

(56) References Cited

U.S. PATENT DOCUMENTS 5,441,146 A * 8/1995 Ziegler ..... B65B 59/005 198/347.2
5,915,524 A * 6/1999 Horlacher ..... B65B 59/005 198/473.1

FOREIGN PATENT DOCUMENTS

| | | |
|---|---|---|
| DE | 10 2007 050 490 | 4/2009 |
| DE | 102009041527 | 2/2011 |
| DE | 102009040977 | 3/2011 |
| DE | 102009058219 | 6/2011 |
| DE | 102011112281 | 2/2013 |
| DE | 102011112300 | 3/2013 |
| DE | 102011054890 | 5/2013 |
| DE | 102011086708 | 5/2013 |
| EP | 0572107 | 12/1993 |
| EP | 2292402 | 3/2011 |

(Continued)

*Primary Examiner* — William R Harp
(74) *Attorney, Agent, or Firm* — Occhiuti & Rohlicek LLP

(57) ABSTRACT

In a container treatment device, retaining-and-centering units hold a container as it traverses a transport path that passes through a set of treatment stations, each having a rotor that propels a retaining-and-centering unit along the transport path. Sometimes, a retaining-and-centering unit becomes defective and must be removed from the transport path. A storage-and-replacement device receives a defective retaining-and-centering unit that is removed from the transport path and supplies a replacement. This occurs with no interruption of operation.

20 Claims, 2 Drawing Sheets

(56) References Cited

FOREIGN PATENT DOCUMENTS

| | | |
|---|---|---|
| EP | 2556943 | 2/2013 |
| WO | 20130029711 | 3/2013 |

* cited by examiner

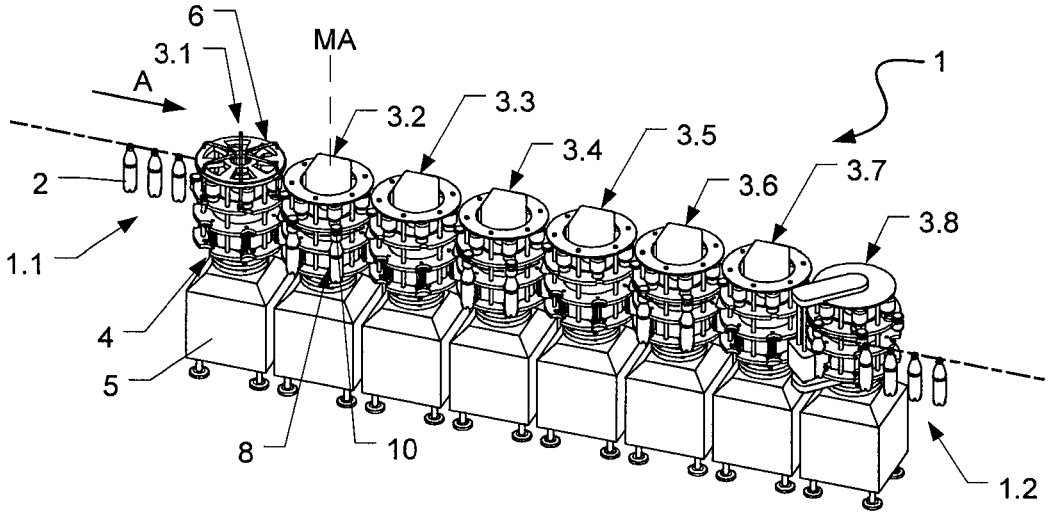
Fig. 1
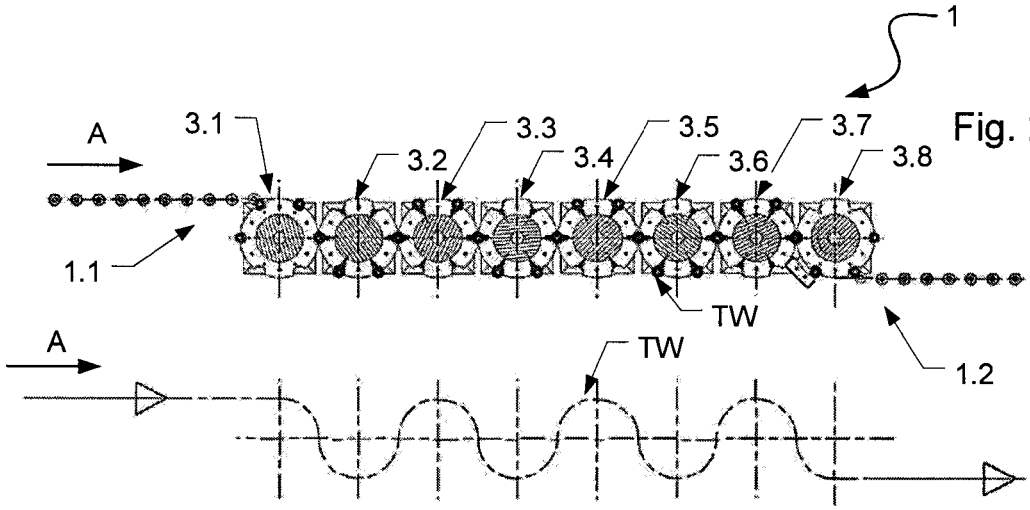
Fig. 2a
Fig. 2b

CONTAINER TREATMENT DEVICE WITH A DEVICE FOR REPLACING RETAINING AND CENTERING UNITS

RELATED APPLICATIONS

This is the national stage, under 35 USC 371, of international application PCT/EP2016/068705, filed on Aug. 4, 2016, which claims the benefit of the Aug. 28, 2015 priority date of German application DE 10-2015-114-344.5, the contents of which are herein incorporated by reference.

FIELD OF INVENTION

The invention relates to a container-treatment machine, and in particular, to maintenance of container-treatment machines.

BACKGROUND

It is known to have a retaining-and-centering unit that escort a container through the various machine modules that process the container. At the container outlet, the retaining-and-centering unit releases the container and the travels back to the container inlet to pick up a new container.

The retaining-and-centering units inevitably undergo considerable wear and tear. Like most objects that undergo wear and tear, sooner or later they will break. This poses a difficulty because the entire container-treatment machine must then be stopped. This results in unwanted downtimes of the container-treatment machine.

SUMMARY

The invention described herein provides a way to reduce downtime that results from a broken retaining-and-centering unit.

According to a first aspect, the invention relates to a container-treatment machine. The container-treatment machine comprises a container-transport path on which the containers to be treated are moved in a transport direction from a container inlet to a container outlet. The treatment of the containers takes place along this transport path.

The container-transport path is formed by a plurality of transport elements that can be driven in a circular manner about a vertical machine-axis. To run through the transport path, the containers are arranged on retaining-and-centering units.

The transport elements receive, support, and move the retaining-and-centering units. The retaining-and-centering units retain, center, and/or move the containers in a controlled manner during treatment.

A storage-and-replacing device for retaining-and-centering units interacts with at least one transport element. The storage-and-replacing device includes receiving areas for retaining-and-centering units. These receiving retaining-and-centering units are to be removed from service and replaced. The storage-and-replacing device replaces these with a replacement retaining-and-centering units from a reserve of spare retaining-and-centering units.

An advantage of the foregoing apparatus is that it becomes possible to replace retaining-and-centering units during ongoing operation without having to sustain downtimes and reductions in throughput. This enhances the efficiency of the container treatment.

Some embodiments convey the retaining-and-centering units in a circular manner on a transport path that comprises a container-treatment section as well as a return section.

In the container-treatment section, the retaining-and-centering units hold containers as those containers undergo various treatment steps, such as pre-treatment, inspection, printing, and drying. At the end of the container-treatment section of the transport path, the retaining-and-centering unit releases its container. Now empty, the retaining-and-centering unit returns along the return section to the container inlet, where it picks up a new container to escort along the container-treatment section of the transport path.

The conveying of the retaining-and-centering units on the transport path can be effected continuously or intermittently.

The storage-and-replacing device is provided separately from the transport path. It is called into action when the need arises, and in particular, when a retaining-and-centering unit becomes defective or requires preventive service. Within the claims, the term "defective" is used to cover both of these meanings for conciseness.

The storage removes defective retaining-and-centering units from the transport path and replaces them with replacement retaining-and-centering units in a seamless manner so that no interruption of operation is necessary.

According to one embodiment, for the retaining-and-centering units the storage-and-replacing device comprises at least one rotor which can be driven to rotate about a vertical machine axis and which has a plurality of receiving areas for the retaining-and-centering units, which (receiving areas) are provided around the periphery. This at least one rotor interacts with one or a plurality of transport elements in such a way that a discharging of the retaining-and-centering unit and/or an introducing of the replacement retaining-and-centering unit is effected when the rotor rotates in the opposite direction to the transport element. A receiving area of the at least one rotor is guided synchronously past a receiving area of the transport element in such a way that the transfer of the replacement retaining-and-centering unit takes place in the moment in which the receiving areas lie opposite one another.

As a result, a discharging and/or introducing of a retaining-and-centering unit can be effected while the device is in operation.

According to one embodiment, a single rotor is provided which is provided for the at least occasionally temporally overlapping withdrawal of a retaining-and-centering unit that is to be replaced, and for supplying a retaining-and-centering unit that replaces it. In other words, the rotor of the storage-and-replacing device simultaneously receives the retaining-and-centering unit that is to be replaced and supplies the replacement retaining-and-centering unit to the transport element. A time-optimized discharging/introducing of the retaining-and-centering units is achieved in this way.

According to one embodiment, the storage-and-replacing device comprises at least two rotors, with a first rotor being provided for discharging the retaining-and-centering unit that is to be replaced, and a second rotor being provided for supplying the replacement retaining-and-centering unit. The first rotor is arranged for example upstream of the second rotor in the transport direction. After the transfer of the retaining-and-centering unit which is defective or to be serviced to the storage-and-replacing device on the transport element of the container-treatment machine therefore, a free receiving area is created into which a replacement retaining-and-centering unit supplied by the second rotor can then be introduced.

The first and second rotor of the storage-and-replacing device can be provided either on the same transport element or on different transport elements. The rotors are preferably provided in direct succession peripherally on a transport element.

According to one embodiment, the storage-and-replacing device for the retaining-and-centering units comprises, at at least one receiving area, a retaining-and-centering unit that is to be introduced, and thus furnishes at least one free receiving area for accepting a retaining-and-centering unit that is to be replaced. As explained above, the retaining-and-centering unit that is to be introduced (replacement retaining-and-centering unit) and the free receiving area for accepting a retaining-and-centering unit that is to be replaced are provided on a single rotor (for example vertical offset) or on different rotors (discharging rotor and introducing rotor).

According to one embodiment, the receiving area that is to supply the retaining-and-centering unit that is to be replaced, and the receiving area that is to supply the retaining-and-centering unit that is to be introduced, are arranged offset from one another in the vertical direction. In this way, a transfer of the retaining-and-centering unit that is to be replaced from the transport element of the container-treatment machine to the storage-and-replacing device (the discharging operation) and—in the inverse direction—a delivery of the replacement retaining-and-centering unit from the rotor of the storage-and-replacing device to the transport element of the container-treatment machine (the introducing operation) can be simultaneously achieved using a single rotor in the storage-and-replacing device.

Preferably the transport element interacting with the storage-and-replacing device analogously provides receiving areas arranged offset from one another in the vertical direction. In this way the transport element can also simultaneously receive a replacement retaining-and-centering unit from the storage-and-replacing device and transfer the retaining-and-centering unit that is to be replaced to the storage-and-replacing device.

The storage-and-replacing device is preferably provided in the region of the container inlet, in particular on a transport element on which the arranging of the containers to be treated at the retaining-and-centering unit is performed. The arranging of the storage-and-replacing device at this location is advantageous because it is here that the retaining-and-centering units are available with no containers arranged on them.

According to one embodiment the device is configured in such a way that, during container treatment, discharging information is obtained which identifies a retaining-and-centering unit as one to be discharged. During container treatment for example, certain functionalities of the retaining-and-centering unit (securing mechanism for securing the containers), conditions of the container (e.g. the pressure inside the container when filled with a pressurized medium) or other parameters (concentricity) can be monitored and discharging information can be generated in case of faults or deviations from target parameters or parameter ranges.

According to one embodiment, a return path is provided for returning the retaining-and-centering units. The storage-and-replacing device is initially arranged in the region of the return path, preferably in the end region of the return path. In this way it can be ensured that after a fault is found in a retaining-and-centering unit during container treatment, the time taken for the return of this retaining-and-centering unit to the container inlet can be used to prepare the discharging of the defective retaining-and-centering unit and the introducing of the replacement retaining-and-centering unit. In other words, the timing of the introducing/discharging process is significantly improved without compromising the performance of the device.

According to one embodiment the discharging of the retaining-and-centering unit is initiated controlled by the discharging information. In other words, whether a retaining-and-centering unit has to be replaced or not is decided based on the monitoring of parameters within the container-treatment machine as described above. If the parameters indicate that a replacement is necessary, discharging information is generated which initiates the replacement of the retaining-and-centering unit which is defective or to be serviced.

According to one embodiment the at least one rotor is driven to rotate continuously. Alternatively the at least one rotor is accelerated from standstill or from a low rotational speed to a target rotational speed to discharge and introduce the retaining-and-centering unit as the need arises. A replacing of the retaining-and-centering unit while the device is running can be achieved in this way.

According to one embodiment, a free receiving area of the storage-and-replacing device is moved synchronously with a transport element to bring about a discharging of the retaining-and-centering unit from the transport element to the storage-and-replacing device. As a result, the interacting receiving areas for the retaining-and-centering units are brought into proximity with one another to allow the retaining-and-centering unit to be transferred between the transport element and the rotor of the storage-and-replacing device.

According to one embodiment, a receiving area of the storage-and-replacing device which (receiving area) comprises a replacement retaining-and-centering unit is moved synchronously with a free receiving area on the transport element in order to bring about the transfer of the replacement retaining-and-centering unit from the storage-and-replacing device to the transport element. This synchronous movement is achieved in particular by a counter-rotational drive of the rotor of the storage-and-replacing device and of the rotationally driven transport element of the container-treatment machine.

In this way, the transfer of the replacement retaining-and-centering unit to the transport element while the system is running in operation can be brought about by for example slackening holding forces on the storage-and-replacing device and applying corresponding holding forces on the transport element of the container-treatment machine.

According to one embodiment the storage-and-replacing device comprises a reserve with a plurality of replacement retaining-and-centering units. This reserve can be achieved for example by a plurality of receiving areas arranged distributed peripherally on the rotor of the storage-and-replacing device and at each of which one retaining-and-centering unit is provided. Alternatively, magazine-like receiving areas can be provided on the storage-and-replacing device, in particular on the rotor of the storage-and-replacing device.

According to one embodiment, the receiving areas of the storage-and-replacing device and/or of the transport element of the storage-and-replacing device comprise an adjusting device by which the retaining-and-centering units arranged at the receiving areas can be displaced in a radial and/or vertical direction. In this way, where there is a plurality of overlying receiving areas for the retaining-and-centering units, it is possible to achieve a feeding at the required height or—in the case of the transport element of the storage-and-replacing device-a moving of the newly received retaining-and-centering unit to the height at which container treatment is performed.

According to one embodiment, the storage-and-replacing device can be placed in an active position and a deactivated position; when in the active position it interacts with at least one transport element to introduce and/or discharge a retaining-and-centering unit and when in the passive position no introducing and/or discharging of a retaining-and-centering unit takes place. The storage-and-replacing device can for example be displaced radially relative to the transport element of the container-treatment machine for this purpose. Alternatively or additionally it is possible for the height of the storage-and-replacing device to be changed (i.e. vertically) for it to be deactivated.

According to a further aspect the invention relates to a method for treating containers by way of a container-treatment machine. The container-treatment machine comprises a container-transport path on which the containers to be treated are moved in a transport direction from a container inlet to a container outlet. The container-transport path is formed by a plurality of transport elements which can be driven to rotate about a vertical machine axis, with the transport elements performing a receiving, holding and moving of retaining-and-centering units and with the containers being held, centered and/or moved in a controlled manner by way of the retaining-and-centering units during container treatment. Here, a storage-and-replacing device interacts with at least one transport element, with the storage-and-replacing device comprising a plurality of receiving areas for retaining-and-centering units and the storage-and-replacing device discharging a retaining-and-centering unit that is to be replaced and in its place introduces a replacement retaining-and-centering unit which is stored as a reserve.

The term "container" in the sense of the invention is used to refer to all packaging, in particular bottles, cans etc.

The term "retaining-and-centering unit" in the sense of the invention is used to refer to a unit which can be detachably connected to a handling station of a container handling machine and used to hold and center a container relative to the handling station. In particular, the retaining-and-centering unit can be provided to hold the container suspended by the region of its container mouth.

For the purpose of the invention the expressions "substantially" or "around" mean variations from the respective exact value by ±10%, preferably by ±5% and/or variations in the form of changes insignificant for the function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of embodiment examples with reference to the figures. In the figures:

FIG. 1 shows a perspective view of a container treatment-machine comprising a plurality of machine modules;

FIG. 2*a* shows view from above the container-treatment machine of FIG. 1;

FIG. 2*b* shows a serpentine path extending through the machine modules in FIG. 2*a;*

DETAILED DESCRIPTION

Figure 3:
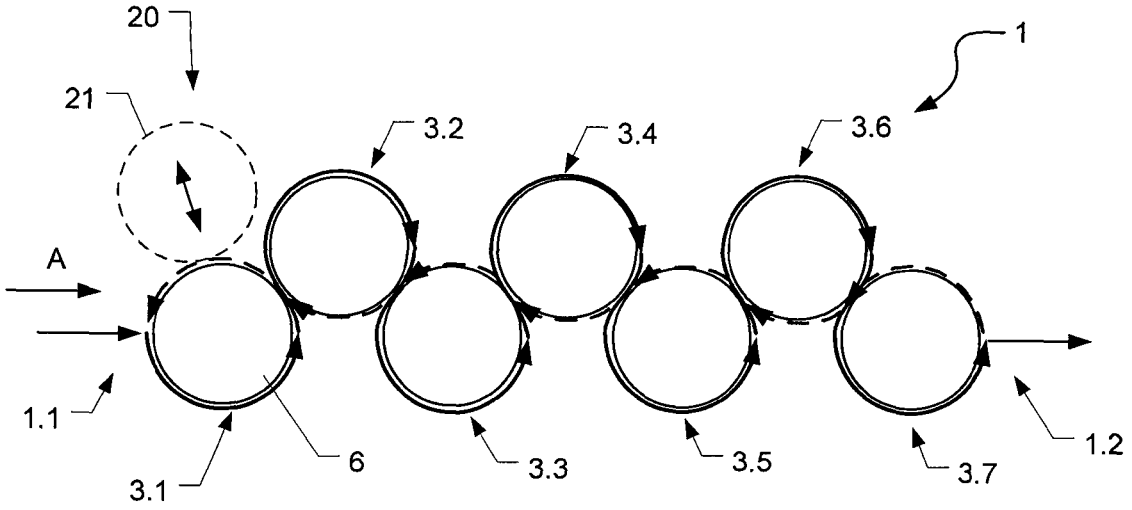
FIG. 3 shows a first embodiment of a container-treatment machine having a storage-and-replacing device viewed from above.

FIG. 1 shows a container-treatment machine 1 that is used to apply a furnishing to a container 2. An example of a furnishing is a printed image made in one or more passes. An example of a container 2 is a bottle. In some embodiments, the container-treatment machine 1 prints directly on the surface of a container using an inkjet print head.

Containers to be printed upon are fed standing upright or suspended through a container inlet 1.1. Referring to FIGS. 2*a* and 2*b*, the containers 2 move in a transport direction A along a serpentine path TW between machine modules 3.1-3.8 from the container inlet 1.1 to the container outlet 1.2. After having been printed upon, the containers 2, still standing upright or suspended, pass through the container outlet 1.2 to another use.

The machine modules succeed one another in transport direction A. In the illustrated embodiment, there are eight such machine modules 3.1-3.8. However, other embodiments can have more than eight or fewer than eight depending on the application. The machine modules 3.1-3.8 all use the same kind of base unit 4. The machine modules 3.1-3.8 thus differ from each other in the nature of the functional elements that they carry.

Each base unit 4 has a module housing 5 and a transport element 6 arranged on top of the module housing 5. The module housing 5 houses a control unit and a drive for driving the transport element 6 about a vertical machine axis MA.

Each transport element 6 has identical treatment units, also referred to as "treatment modules," attached to its periphery in order to equip the machine module 3.1-3.8 for a particular functionality. Each treatment module forms a treatment station 8. The treatment stations 8 perform different parts of the entire process of treating a container 2. Examples of different types of treatment station 8 include those that include pre-treatment units, sterilizers, detectors for detecting various container features, printing units, which typically have inkjet print heads, and post-treatment units, such as those for drying a recently-printed image and for inspecting it.

A retaining-and-centering unit 10 retains a container 2 at particular treatment station 8. Each retaining-and-centering unit 10 receives a container 2 as it enters the container inlet 1.1 and chaperones that container 2 as it passes through each of the machine modules 3.1-3.8 on its way from the container inlet 1.1 to the container outlet 1.2. The retaining-and-centering unit 10 then releases the container when it reaches the container outlet 1.2. In some embodiments, the retaining-and-centering unit 10 also spins the container about its vertical container axis. This permits a stationary print head to print along different circumferential angles on the container.

Each treatment station 8 has some mechanism for the various retaining-and-centering units 10 that visit it. This mechanism is configured to hold the retaining-and-centering unit during treatment and to release it when treatment is finished. The engaging mechanism usually takes the form a mounting to which a retaining-and-centering unit 10 can be detachably attached. Thus, in operation, as treatment is carried out, the transport element 6 will also be rotating the retaining-and-centering unit onward in the transport direction A at the same time.

At some point there is a handover between first and second adjacent machine modules 3.*i*, 3.(*i*+1). In particular, a retaining-and-centering unit 10 with its accompanying container 2 is handed off from a releasing treatment-station 8 of a first transport-element 6 to a receiving treatment-station 8 of a second transport-element 6 on the immediately successive machine module 3.(*i*+1). This takes place at the instant that the releasing treatment-station 8 and the receiving treatment-station 8 are opposite each other.

The transport elements 6 of the individual machine modules 3.1-3.8 are arranged adjacent to one another and are driven to rotate synchronously but in opposite directions. This lets the transport elements 6 form a transport device that moves containers 2, each of which is held at a retaining-and-centering unit 10, within the container-treatment machine 1 along the serpentine transport path TW shown in FIG. 2*b* between the container inlet 1.1 and the container outlet 1.2.

The individual containers 2 are each transferred directly from the transport element 6 of one machine module 3.*i* (for i=1 to n−1, where n is the number of machine modules) to the transport element 6 of the machine module 3.2-3.(*i*+1) that follows in transport direction A as they make their way toward the container outlet 1.2. The continuous rotational drives of each transport element 6 cooperate to cause a non-intermittent flow of containers 2 through the container-treatment machine 1.

As shown schematically in FIG. 3, although the retaining-and centering unit 10 releases its container 2 at the container outlet 1.2, it stays engaged to the last transport element 6 at the last machine module 3.7.

The same transport mechanism that propelled the loaded retaining-and-centering units 10 from the container inlet 1.1 to the container outlet 1.2 also works in reverse. It is therefore available to transport empty retaining-and-centering units 10 back from the container outlet 1.2 to the container inlet 1.1 so that they can be used all over again. This can be seen by the meandering broken-line shown in FIG. 3 that leads from the container outlet 1.2 back to the container inlet 1.1. As the empty retaining-and-centering units 10 make their way back to the container inlet 1.1, treatment stations 8 that are not currently being used, for example that have just completed treatment of a container and are on their way back to pick up the next container, are available to propel an empty retaining-and-centering unit 10 back towards the container inlet 1.1.

As mechanical units, the retaining-and-centering units 10 are subject to wear. Of particular concern are the retaining-and-centering unit's gripper mechanism, which it uses to hold a container 2, and a bearing that spins the container 2 during printing. These mechanical components require regular service, and even then are prone to failure.

Each retaining-and-centering unit 10 also has electronic components. For example, each retaining-and-centering units 10 includes electronic components for exchanging data with the respective treatment stations 8 or with the machine modules 3.1-3.n. In some cases, the retaining-and-centering units 10 also comprise electronic identification circuitry. These electronic components can also fail.

To avoid having to shut down the entire container-treatment machine 1 to service or replace a retaining-and-centering units 10, it is useful for the container-treatment machine 1 to have a storage-and-replacing device 20, as show in FIG. 3.

The storage-and-replacing device 20 is configured so as to selectively discharge a first retaining-and-centering unit 10 from the transport path and to introduce a second retaining-and-centering unit 10 in its place. In most case, the first retaining-and-centering unit 10 is defective or has to be serviced. This swapping of retaining-and-centering units is carried out during ongoing operation of the container-treatment machine 1 at the target rotational speed of the transport elements 6. As a result, it is possible to swap retaining-and-centering units 10 with no reduction of throughput.

As shown schematically in FIG. 3, the storage-and-replacing device 20 also comprises at least one rotationally drivable rotor 21 that has receiving areas distributed around its periphery at each of which a retaining-and-centering unit 10 can be detachably attached.

The rotor 21 receives discharged retaining-and-centering units 10 and introduces new retaining-and-centering units 10 by synchronously counter-rotating with the transport element 6. The rotor 21 is arranged on the transport element 6 when a retaining-and-centering unit 10 is to be swapped out, a free receiving area is available to receive it, and when a new retaining-and-centering unit 10 is to be swapped in, a free receiving area in the transport element 6 is available to receive it. The swapping, whether it is swapping in or swapping out, takes place at the instant when the relevant areas of the rotor 21 and the transport element 6 are opposite each other.

In some embodiments, swapping out a defective retaining-and-centering unit 10 and swapping in a replacement retaining-and-centering unit 10 take place at the same time, or during overlapping time intervals. During this procedure, the rotor 21 transfers the replacement retaining-and-centering unit 10 to the transport element 6 and the transport element 6 also transfer the defective retaining-and-centering unit 10 to the rotor 21.

A plurality of receiving areas for the retaining-and-centering units 10 are arranged vertically above one another so as to facilitate temporally overlapping swapping of a discharged retaining-and-centering unit 10 and a replacement retaining-and-centering unit 10.

In one embodiment, the replacement retaining-and-centering unit 10 is at an upper receiving-area of the rotor 21 while an upper receiving-area of the transport element 6 of a machine module 3.1-3.n is free to receive the replacement retaining-and-centering unit 10.

Conversely, the lower receiving-area of the transport element 6 can be occupied by the retaining-and-centering unit 10 that is to be discharged while the corresponding lower receiving-area on the rotor 21 is free to receive that retaining-and-centering unit 10 as it is discharged.

Other possibilities for the simultaneous or at least partial temporally overlapping replacement of the retaining-and-centering units 10 are also conceivable.

Figure 4:
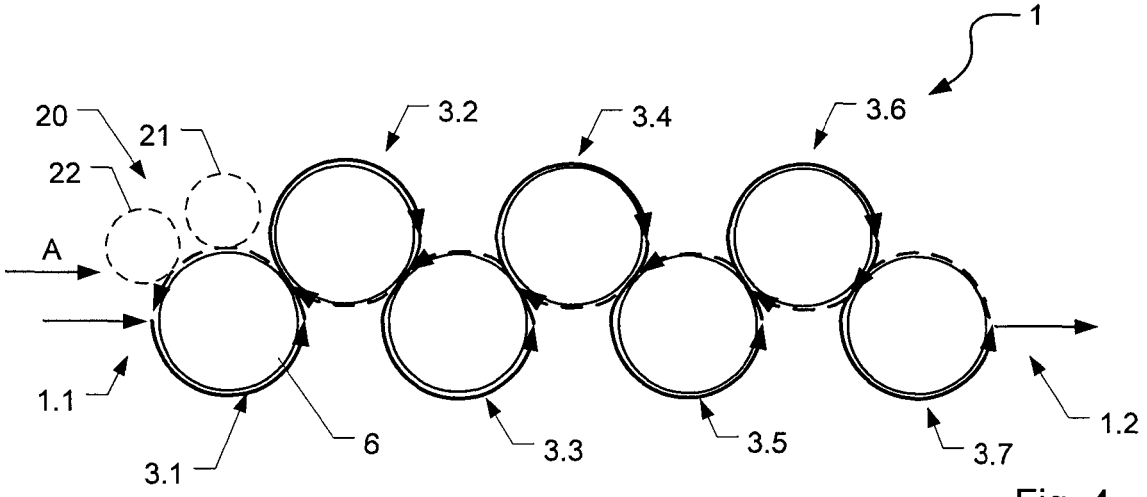
FIG. 4 shows a second embodiment of a container-treatment machine having a storage-and-replacing device viewed from above.

FIG. 4 shows another embodiment of a storage-and-replacing device 20 interacting with a container-treatment machine 1. Unlike the embodiment according to FIG. 3, in which the same rotor both receives discharged retaining-and-centering units 10 and introduces replacement retaining-and-centering units 10, this alternative embodiment splits these tasks among first and second rotors 21, 22. The first rotor 21 receives the discharged retaining and centering unit 10. The second rotor 22 introduces the replacement retaining-and-centering unit 10.

The first rotor 21 has one or more free receiving areas into which the transport element 6 introduces discharged retaining-and-centering units 10 as the rotor 21 and transport element 6 rotate synchronously in opposite directions.

The first rotor 21 has one or more free receiving areas into which, as the rotor 21 is driven counter-rotationally relative to the transport element 6 of the final machine module 3.n, the retaining-and-centering unit 10 discharged by the transport element 6 of the machine module 3.1-3.n can be introduced. This creates a free receiving area at the transport element 6 of the machine module 3.n into which the replacement retaining-and-centering unit 10 can be introduced by the second rotor 22.

For this purpose, the second rotor 22 comprises one or more receiving areas, each which is occupied by a replacement retaining-and-centering unit 10 so that, as the rotor 22 is driven counter-rotationally relative to the transport element 6 of the machine module 3.n, a replacement retaining-and-centering unit 10 can be transferred to the now-vacant receiving area on the transport element 6.

The discharging and/or introducing of the retaining-and-centering unit 10 take only as required. This means that the rotor 21, 22 can remain stationary much of the time.

Preferably the rotor 21, 22 is placed at some distance away from the transport path of the retaining-and-centering units 10, as indicated by the double arrow in FIG. 3 for example. Should it become necessary to replace a retaining-and-centering unit 10, the rotor 21, 22 can be brought up to target rotational speed. and also moved towards the transport path, as shown in FIG. 3.

The rotor 21, 22 is operated synchronously with the transport element 6 of the machine module 3.n in a way that facilitates the swapping of a defective retaining-and-centering unit 10 for a replacement retaining-and-centering unit 10.

Fault-detection circuitry provides information indicating a need to swap retaining-and-centering units 10 as described above. Such fault-detection circuitry detects such defects. Examples of such defects, without limitation, are a defective data-exchange between the machine module and the retaining-and-centering unit 10, insufficient holding force exerted by retaining-and-centering unit 10, and a loss of pressure in the container 2.

Detection of a fault triggers a swapping procedure. The swapping procedure begins with the creation of discharge information. Such discharge information contains information necessary to discharge the correct retaining-and-centering unit 10. Examples of such information include the current position of the defective retaining-and-centering unit 10 and information uniquely identifying the retaining-and-centering unit 10.

The swapping procedure continues with bringing the storage-and-replacing device 20 out of standby mode. In particular the at least one rotor 21, 22 is set in rotation such that its rotary motion synchronized with that of the transport element 6 with which the rotor 21, 22 interacts in such a way that, based on the discharging information, a targeted discharge of the defective retaining-and-centering unit 10 and introduction of the replacement retaining-and-centering unit become possible.

Because it takes some time to bring the storage-and-replacing device 20 out of standby mode, it is useful to place it immediately before the container inlet 1.1. This will tend to maximize the amount of time between detecting a defect and the arrival of the defective retaining-and-centering unit 10 at the storage-and-replacing device 20.

The storage-and-replacing device 20 includes a reserve of retaining-and-centering units that can be used as replacements. In some embodiments, the reserve is carried on the rotor 21, 22 itself. In such embodiments, each of a plurality of receiving areas distributed around a periphery of the rotor 21, 22 has its own replacement retaining-and-centering unit. This means that, depending on the rotational position at the time of the transfer, a particular replacement retaining-and-centering unit can be transferred to a transport element 6 of the container-treatment machine.

In addition or alternatively, one or more receiving areas can be provided with a vertical adjusting device that interacts with a receiving shaft along which retaining-and-centering units 10 are stacked vertically above one another to for the reserve. A plurality of retaining-and-centering units 10 can be held in reserve at a peripheral position of the rotor 21, 22 as a result.

Similarly, it is preferable that the storage-and-replacing device 20 have storage capacity for a plurality of defective retaining-and-centering units 10. To achieve this, the rotor 21, 22 can have a plurality of empty receiving areas distributed peripherally around the rotor 21, 22. Each of these receiving areas can then accommodate a defective retaining-and-centering unit 10 by the controlled movement of the rotor 21, 22 so that the defective retaining-and-centering unit 10 is transferred to the storage-and-replacing device 20 as the rotor 21, 22 interacts with the transport element 6.

In some embodiments, one or more receiving areas of the rotor 21, 22 include a vertical adjusting device that interacts with a receiving shaft in which a plurality of the retaining-and-centering units 10 are stacked vertically above one another. This increases the storage capacity for defective retaining-and-centering units 10.

Measures can also be taken to prevent collisions when the rotor 21, 22 of the storage-and-replacing device 20 is at a standstill and not being used. One such measure is to displace the unused rotor 21, 22 radially away from the axis of rotation of the transport element 6 with which the rotor 21, 22 is intended to interact, as indicated by the double arrow in FIG. 3. This will tend to avoid a collision with the transport element 6 of a machine module 3.1-3.n.

Alternatively or in addition a sensor configured to detect an impending. This sensor can then generate a signal that is relied upon to control rotation or translation of the rotor 21, 22 to avoid a collision.

As described herein, it has been assumed that the retaining-and-centering unit 10 being swapped out is not holding a container. However, the procedure is agnostic to whether there is a container or not.

The invention has been described hereinbefore by reference to embodiments. It goes without saying that a plurality of variations or modifications are possible without departing from the inventive concept underlying the invention.

The invention claimed is:

1. An apparatus for container treatment, said apparatus comprising a storage-and-replacing device and transport elements, wherein said transport elements define a container-transport path that extends between a container inlet and a container outlet, wherein each of said transport elements receives, supports, and moves retaining-and-centering units part way along said transport path, as a result of which each retaining-and-centering unit is handed over by one transport element to another transport element so that each retaining-and-centering unit traverses said container transport path from said container inlet to said container outlet, wherein said retaining-and-centering units each receive, retain, center, move, and release a container in a controlled manner during treatment thereof, wherein each of said transport elements is driven to rotate about a vertical machine-axis thereof, wherein said transport elements comprise a first transport-element, wherein said storage-and-replacing device interacts with said first transport-element, wherein said storage-and-replacing device comprises receiving areas, wherein said storage-and-replacing device and said first transport-element are configured to cooperate such that when said first transport-element discharges a defective retaining-and-centering unit out of said transport path said storage-and-replacing device retrieves a replacement retaining-and-centering unit and introduces said replacement retaining-and-centering unit into said transport path as a replacement for said defective retaining-and-centering unit that has been discharged from said transport path while said transport elements are moving at a target rotational speed thereof, thereby swapping retaining-and-centering elements into and out of said transport path with no reduction in throughput.

2. The apparatus of claim 1, wherein said storage-and-replacing device comprises a first rotor, wherein said first rotor rotates about a vertical machine-axis thereof, and wherein, around a periphery thereof, said first rotor comprises said receiving areas, wherein a retaining-and-centering unit can be detachably attached at each of said receiving areas.

3. The apparatus of claim 2, wherein said storage-and-replacing device comprises at most said first rotor, wherein said first rotor receives said defective retaining-and-centering unit and also supplies said replacement retaining-and-centering unit, wherein said first rotor receives said defective retaining-and-centering unit during a first time interval, wherein said first rotor supplies said replacement retaining-and-centering unit during a second time interval, and wherein said first and second time intervals at least partially overlap.

4. The apparatus of claim 2, wherein said storage-and-replacing device comprises a second rotor, wherein said first rotor receives said defective retaining-and-centering unit that is discharged from said transport path and said second rotor provides said replacement retaining-and-centering unit for placement on said transport path as a replacement for said defective retaining-and-centering unit.

5. The apparatus of claim 4, wherein said first and second rotor interact with said first transport element and wherein the first and second rotors rotate synchronously in opposite direction.

6. The apparatus of claim 4, wherein said transport elements comprise a second transport-element, wherein said first rotor interacts with said first transport-element and said second rotor interacts with said second transport-elements.

7. The apparatus of claim 1, wherein said storage-and-replacing device comprises, at a first receiving area, said replacement retaining-and-centering unit that is to be introduced into said transport path, wherein said storage-and-replacing device comprises a second receiving area for accepting said defective retaining-and-centering unit, which is to be replaced by said replacement retaining-and-centering unit, said defective retaining-and-centering element having traversed a plurality of said transport elements, and wherein said first receiving area is occupied and said second receiving area is free.

8. The apparatus of claim 7, wherein said first and second receiving areas are vertically offset relative to each other.

9. The apparatus of claim 8, wherein said first transport-element comprises receiving areas that are vertically offset relative to each other.

10. The apparatus of claim 1, wherein said first transport-element is disposed at said container inlet.

11. The apparatus of claim 1, wherein said defective retaining-and-centering unit is identified based on discharging information that is indicative of a defect in said defective retaining-and-centering unit, wherein said discharging information is obtained during container treatment.

12. The apparatus of claim 11, wherein said discharging information triggers a discharging process that ultimately causes removal of said defective discharging information is obtained during container treatment.

13. The apparatus of claim 1, further comprising a return path that extends between said container inlet and said container outlet, wherein said storage-and-replacing device is disposed at an end of said return path.

14. The apparatus of claim 1, wherein said storage-and-replacing device is operated in a manner such that, when a decision is made to discharge said defective retaining-and-centering unit, a rotor is made to sustain an angular acceleration until an angular velocity of said rotor is sufficient to receive said defective retaining-and-centering unit, wherein said storage-and-replacing device has a structure that permits said operation, wherein as a result of having said structure, said storage-and-replacing device possesses the capability of being able to sustain said angular acceleration until said angular velocity of said rotor becomes sufficient to receive said defective retaining-and-centering element.

15. The apparatus of claim 1, wherein said first transport-element rotates with a first angular velocity, wherein said receiving area rotates with a second angular velocity, and wherein said first angular velocity and said second angular velocity have equal magnitudes.

16. The apparatus of claim 1, wherein a receiving area on said storage-and-replacing device contains said replacement retaining-and-centering unit, wherein a receiving area on said first transport-element is free to receive said replacement retaining-and-centering unit, wherein said receiving area on said storage-and-replacing device is driven to move with first angular velocity, wherein said receiving area on said first transport-element is driven to move with a second angular velocity, and wherein said first and second angular velocities have equal magnitudes, whereby said replacement retaining-and-centering unit is transferred from said storage-and-replacing device to said first transport-element to be placed on said transport path.

17. The apparatus of claim 1, wherein said retaining-and-centering units each comprise a gripper mechanism, a bearing, and electronic components.

18. The apparatus of claim 1, wherein a receiving area in one of said storage-and-replacing device and said first transport-element comprises a receiving area that contains a retaining-and-centering unit, wherein a retaining-and-centering unit at said receiving area can be vertically displaced.

19. The apparatus of claim 18, wherein said retaining-and-centering unit can also be radially displaced.

20. A method comprising identifying a defective retaining-and-centering unit that is being conveyed along a transport path by a plurality of transport elements as being a defective retaining-and-centering unit, said transport path extending between a container inlet and a container outlet, after said defective retaining-and-centering unit has arrived at a first transport-element from said plurality of elements, causing said defective retaining-and-centering unit to be transferred from said first transport-element to a storage-and-replacing device, thereby removing said defective retaining-and-centering unit from said transport path, and, while said defective retaining-and-centering unit is being removed from said transport path, causing said storage-and-replacing device to replace said defective retaining-and-centering unit with a replacement retaining-and-centering unit while said transport elements are moving at a target rotational speed thereof, thereby swapping retaining-end-centering elemnts into and out of said transport path with no reduction in throughput.

* * * * *